US005251686A

United States Patent [19]

Key

[11] Patent Number: 5,251,686

[45] Date of Patent: Oct. 12, 1993

[54] TUNDISH OUTLET EDGE SEAL AND RISER FOR CONTINUOUS CASTING APPARATUS AND METHOD

[75] Inventor: James C. Key, Garland County, Ark.

[73] Assignee: Reynolds Metals Company, Richmond, Va.

[21] Appl. No.: 959,855

[22] Filed: Oct. 13, 1992

[51] Int. Cl.[5] ..... B22D 11/10; B22D 11/06

[52] U.S. Cl. ..... 164/479; 164/429; 164/489; 222/594; 266/236

[58] Field of Search ..... 164/423, 429, 463, 479, 164/488, 489; 222/591, 594; 266/236

[56] References Cited

U.S. PATENT DOCUMENTS 4,399,860 8/1983 Johns ..... 164/463
4,484,614 11/1984 Maringer .
4,678,719 7/1987 Johns et al. .
4,685,505 8/1987 Truckner et al. .
4,715,428 12/1987 Johns et al. ..... 164/463
4,749,024 6/1988 Bartlett et al. .
4,819,712 4/1989 Bartlett ..... 164/488
4,828,012 5/1989 Honeycutt, III et al. .
4,896,715 1/1990 Honeycutt .
4,934,443 6/1990 Honeycutt, III et al. .
4,940,077 7/1990 Honeycutt, III et al. .
4,945,974 8/1990 Honeycutt, III .
4,955,429 9/1990 Honeycutt, III et al. .
5,063,990 11/1991 Follstaedt et al. .

*Primary Examiner*—Mark Rosenbaum
*Assistant Examiner*—Erik R. Puknys
*Attorney, Agent, or Firm*—Robert C. Lyne, Jr.

[57] ABSTRACT

A method and apparatus for continuously casting metal includes a tundish having edge seals and risers positioned at an outlet portion thereof. The edge seals and risers are configured to reduce the depth of molten metal adjacent the tundish sidewalls such that a lesser volume of molten metal contacts a driven casting surface to permit rapid solidification of edge portions of a cast strip. The edge seals and risers also are configured to form a meniscus between the seals and casting surface to effectively seal a gap between the tundish sidewall and continuous casting surface to prevent molten metal leakage therethrough. Preventing molten metal flow through the gap between the casting surface and sidewalls eliminates the requirement for a mechanical seal during continuous casting of molten metals.

16 Claims, 3 Drawing Sheets

FIG. 4
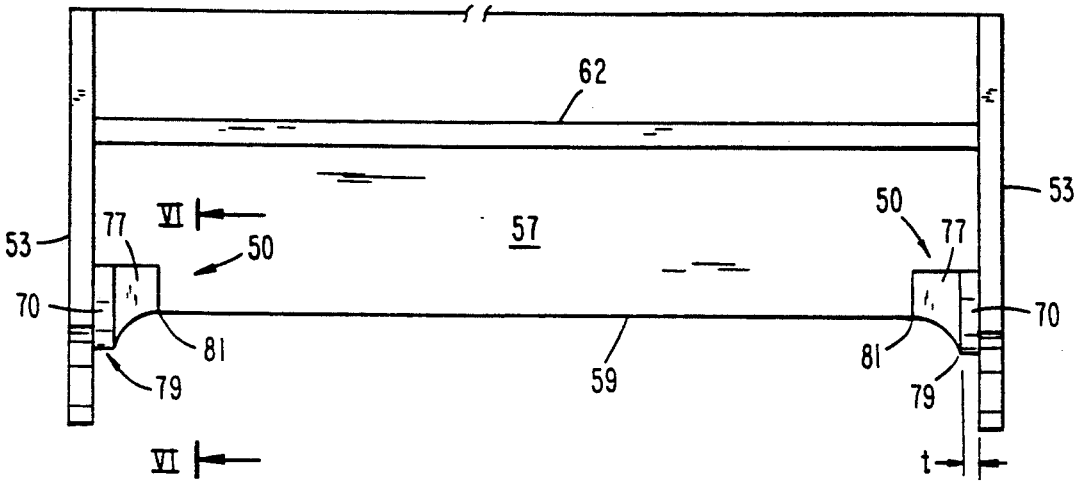
FIG. 5
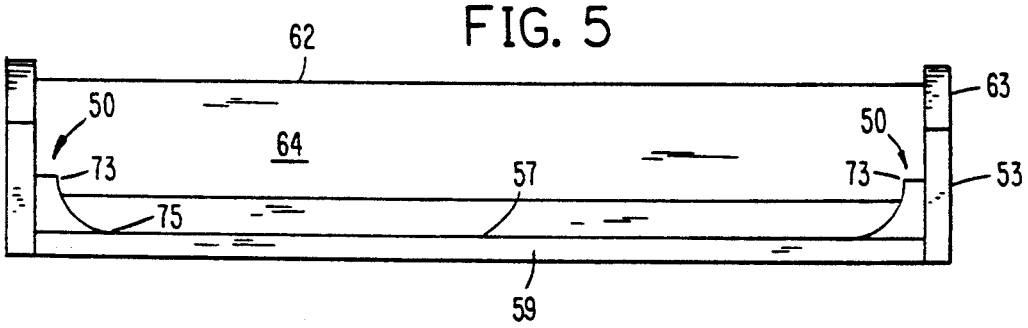
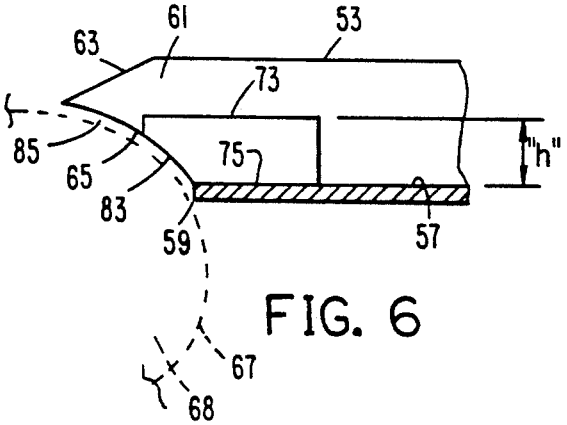
FIG. 6

TUNDISH OUTLET EDGE SEAL AND RISER FOR CONTINUOUS CASTING APPARATUS AND METHOD

FIELD OF THE INVENTION

This invention relates to an edge seal and riser for use in a tundish delivering molten metal onto a driven chill surface for continuous casting of metal strip. The edge seal and riser functions to control molten metal depth in the tundish prior to contact with the driven chill surface and prevent leakage of molten metal between the tundish side runner and driven chill surface.

BACKGROUND ART

In the prior art, it is known to produce aluminum in coil form from a continuous casting apparatus wherein molten aluminum is delivered from a tundish and cast in the form of a metal sheet or strip and rolled into a coil on a coiler. Generally, in this process, molten aluminum is deposited on a moving chill surface from a tundish having an open outlet. An inlet is provided for the flow of molten metal into the tundish from a source of molten metal. The direct casting of the molten aluminum metal onto a chill wheel, preferably a grooved chill wheel, produces a cast aluminum product at a rapid rate. The aluminum cast strip is wound on a coiler in heated form, generally at a temperature in the range of about 900° F.

Drag casting apparatus and methods of this type are described, for example, in U.S. Pat. Nos. 4,828,012, 4,896,715, 4,934,443, 4,945,974, 4,940,077 and 4,955,429. The disclosures of these patents are hereby specifically incorporated by reference with respect to the method and apparatus for the production of aluminum strip and coil from molten aluminum or aluminum alloys.

With reference now to FIG. 1, a continuous casting apparatus is illustrated which is typical of prior art continuous casting apparatus using a driven chill surface. The continuous casting apparatus is generally designated by the reference numeral 10 and is seen to include a tundish 1 positioned adjacent a driven chill surface 3. The chill surface 3 comprises the external cylindrical surface of a casting wheel 5. The casting wheel 5 is internally cooled with circulating water or other conventional cooling fluids to extract heat through the chill surface 3 so as to solidify molten metal 7 exiting the tundish 1.

The casting wheel 5 is supported by journal bearings 9 for rotation about a fixed horizontal axis. The journal bearings 9 are supported on the supporting frame 11 which supports both the bearings and the tundish 1. The casting wheel may be driven by a suitable drive means such as a variable speed motor and reduction gear mechanism, not shown, and a drive chain or belt 13 engaging the casting wheel 5.

After the molten metal 7 contacts the chill surface 3 and is solidified as a strip 15, a coiling apparatus 17 accumulates the strip in coil form for further processing.

The continuous casting apparatus 10 may also include a burner 19 to selectively apply heat to the chill surface at a location beneath the tundish 1. In addition, a top roll 21 may be provided which is uncooled or heated, the top roll being mounted for rotation in contact with the molten metal prior to complete solidification of the strip.

In order to properly coil the as-cast strip or further work the cast strip made by the apparatus of FIG. 1 into a product having a satisfactory quality, it is important to provide a cast strip leaving the casting surface having a proper shape or cross-sectional profile.

Difficulties have been encountered in prior art processes in achieving acceptable cast strip cross-sectional profiles in drag casting of aluminum products. Delivering molten aluminum from a tundish onto a moving chill roller surface produces a sheet product having an increased thickness at the edges thereof. This increased thickness is a result of a faster cooling rate at the edges of the chill surface and a corresponding "dog-bone" effect, or washboard or wavy edge. This condition prevents effective coiling of the cast strip as well as difficulties in further reducing the cast strip in subsequent rolling operations. Cold rolling of sheet or strip product generally requires that the sheet or strip have a slightly thicker center portion than edge portion. Strip having a "dog-bone" shape generally has thick edge portions and a thinner center section.

In the prior art, various devices have been proposed in conjunction with direct or continuous casting apparatus for improved continuous cast strip profile and gauge. In U.S. Pat. No. 4,828,012 to Honeycutt, III et al., a pair of risers or inserts are provided on the outlet edge of the tundish.

With reference now to FIG. 2, the risers as disclosed in U.S. Pat. No. 4,828,012 are illustrated. A pair of risers 23 and 25 are shown located on the top surface 27 of the tundish floor 29. Riser 23 is also adjacent sidewall 31 with riser 25 being adjacent sidewall 33.

The risers 23 and 25 are of generally rectangular configuration in both longitudinal and transverse cross-section so as to provide maximum-thickness at the point of intersection of the outlet 35 of the tundish 1. Each riser then tapers both longitudinally and transversely from the point of maximum thickness to smoothly blend into the top surface 27 of the floor 29.

It is disclosed in U.S. Pat. No. 4,828,012 that the risers 23 and 25 overcome the problem of "dog-bone" effect by increasing the thickness of the lip 35 of the tundish adjacent to the sidewalls 31 and 33 so as to reduce the contact time between the molten metal and the chill surface adjacent the marginal edges of strip.

U.S. Pat. No. 4,749,024 to Bartlett discloses another remedy to offset the natural tendency of direct cast strip to be thicker near the edges. In this patent, the tundish lip is contoured to provide a concave surface for the molten metal exiting the tundish. The object of the contoured tundish lip is to provide a sheet-casting process wherein the thickness profile along the sheet-length and across its width is controllable without changing the gap between the tundish and casting wheel.

U.S. Pat. No. 4,678,719 to Johns et al. discloses another continuous casting apparatus having particularly configured tundish sidewalls. The surfaces of the sidewalls of the tundish diverge to open upwardly to facilitate metal flow. The slight taper tends to improve metal flow from the exit end of the tundish.

U.S. Pat. No. 4,484,614 to Maringer discloses a continuous casting strip apparatus including a tundish for receiving and holding molten metal having a nozzle therein. The nozzle construction promotes rapid casting of metals with a minimum of metal turbulence during casting.

U.S. Pat. No. 4,685,505 to Truckner et al. discloses an improvement in roll casting apparatus using side edge dams for delivering a flow of gas toward the side edges of metal as it passes from a source of molten metal through a pair of opposing roll casting means. The non-contacting side edge dams contain the metal during roll casting from a nozzle tip.

U.S. Pat. No. 5,063,990 to Follstaedt et al. discloses a continuous casting apparatus with a particular weir design in the tundish to provide a more uniform flow of molten metal across the width of the tundish nozzle. The weir design includes a sloped rear wall and tapered sidewalls and a critical gap beneath the weir to reduce edge tearing and provide improved strip uniformity.

However, disadvantages still exist with prior art continuous casting apparatus. First, and with reference to FIG. 2, tundish edge risers fail to reduce the depth of the molten metal exiting the tundish sufficiently so as to cause rapid solidification of the molten metal contacting the chilled driven casting wheel surface. Thus, the molten metal leaks through the gap between the underside surface 37 of the sidewalls 31 and 33 and the casting surface 3. The molten metal then solidifies adjacent the runner surface 37 thus causing contact between the runner and the casting wheel and excessive vibrations during casting. Further, damage or erosion to the gasket between the sidewall and casting wheel surface results in premature shut-down of the casting apparatus. Contact between the surface 37 and wheel 3 also contributes to excessive vibration during casting. Finally, the leakage of molten metal also adversely affects the quality of the cast metal strip edge.

In view of the deficiencies in the prior art designs discussed above, a need has developed to provide improvements in control of molten metal exiting a tundish onto a driven casting wheel during continuous casting of metal strip product. In response to this need, the present invention provides a tundish outlet edge seal and riser which overcomes the disadvantages noted above in the prior art. The tundish outlet edge seal and riser extends outwardly from a tundish lip and along the tundish sidewalls while tapering toward the longitudinal axis of the tundish. None of the prior art discussed above teaches or fairly suggests a tundish riser which performs both a sealing function during continuous casting as well as reducing molten metal depth at the tundish sidewall outlet area to improve both the casting operation and cast strip quality.

SUMMARY OF THE INVENTION

It is accordingly a first object of the present invention to provide an improved tundish outlet edge seal and riser for a continuous casting apparatus and method.

It is another object of the present invention to provide a tundish outlet edge seal and riser which prevents cold metal contact between the tundish sidewalls and the continuous cast strip edge to improve strip edge quality.

Another object of the present invention is to provide a tundish outlet edge seal and riser which provides a sealing function at the edge of the tundish sidewalls to prevent molten metal leaking between the casting wheel and sidewall casting operation disruptions.

It is a further object of the present invention to provide a tundish outlet edge seal and riser which minimizes heat transfer from the casting wheel to the sidewall and thus prevents thermal expansion of the sidewall and unwanted contact between the sidewall and casting wheel during casting operation.

A still further object is to eliminate use of a sealing gasket to further reduce contact between the sidewall and casting wheel.

Other objects and advantages of the present invention will become apparent as the description thereof proceeds.

In satisfaction of the foregoing objects and advantages, the present invention comprises an edge seal and riser for a tundish during the continuous casting of molten metal into a cast strip by flowing molten metal from a tundish onto a moving chill surface. The edge seal and riser is positioned in a tundish having a tundish floor and outlet lip, wherein the tundish floor is arranged between a pair of sidewalls and a portion of each sidewall extends beyond the outlet lip. The edge seals and risers are arranged in the tundish adjacent the sidewalls thereof and the outlet lip.

The edge seals and risers include a first portion which functions to lower the depth of molten metal adjacent the sidewalls near the outlet lip of the tundish and the continuous casting surface. By lowering the depth of molten metal in this area, a more rapid solidification of molten metal occurs at the cast strip edge portions to improve overall strip cross-sectional profile and casting surface quality. The edge seal and risers also include a generally sloped or concave-shaped surface which slopes toward the center of the tundish, a portion extending beyond the tundish lip. By extending outwardly from said sidewall and beyond the tundish lip, a sealing function is achieved which prevents molten metal from escaping through the gap between the casting wheel and tundish sidewall.

The edge seals and moving chill surf ace form a gap which facilitates formation of a meniscus of molten metal, in particular, aluminum. The meniscus contributes to prevention of molten metal leakage through the gap.

The edge seals and risers also provide insulating qualities for the sidewall extending beyond the tundish lip to minimize thermal expansion thereof and interference with the casting wheel rotation.

The present invention also provides a method of producing a continuously cast metal strip having a uniform cross-sectional profile by providing a tundish, providing a moving chill surface and flowing molten metal from the tundish onto the moving chill surface. The method of continuous casting also includes lowering the depth of molten metal in the tundish adjacent the sidewalls thereof at the tundish outlet lip to reduce the thickness of the edge portions of the cast metal strip. The inventive method also includes sealing the gap between the moving chill surface and the tundish sidewalls by forming a meniscus with the molten aluminum between the riser and casting wheel and adjacent the gap.

BRIEF DESCRIPTION OF THE DRAWINGS

Reference is now made to the Drawings accompanying the application wherein:

FIG. 4 is a top view of a continuous casting tundish including the inventive edge seals and risers;

FIG. 5 is a front view of the tundish depicted in FIG. 4; and

FIG. 6 is a sectional view along the line VI—VI shown in FIG. 4.

DESCRIPTION OF THE PREFERRED EMBODIMENTS

The tundish outlet edge seal and riser of the present invention provides improvements both in continuous casting operation and continuous cast strip product quality. The outlet seal and edge riser reduces the depth of the molten metal exiting the tundish at the junction between the tundish sidewalls and tundish floor. As a result of the reduced molten metal thickness, a smaller volume of molten metal contacts the casting wheel surface at the cast strip edge. Thus, the molten metal is permitted to solidify more quickly to form a strip edge side seal and confine molten metal towards the center portion of the strip being cast. The more-quickly solidified molten metal continually moves forward with rotation of the casting wheel thereby preventing molten metal to move sideways toward the sidewalls.

The tundish outlet edge seal and riser also insulates the portion of the tundish sidewall which extends outwardly from the tundish lip from the heat generated by the molten metal. By insulating the tundish sidewall in this particular area, thermal expansion is avoided or minimized and contact between the casting wheel and sidewalls of the tundish are minimized. Further, minimizing heat transfer to the sidewall portions extending outwardly from the tundish substantially minimizes or prevents vibrations caused by contact between the tundish sidewalls and the casting wheel.

By extending the edge seals and risers beyond the tundish floor lip so as to be aligned with the sidewall portion extending past the tundish floor lip, cold metal buildup on the side of the sidewall which causes dross buildup and unacceptable strip edge quality is eliminated. The inventive edge seals and risers also eliminate the need for maintaining a gasket between the sidewall and casting wheel to confine metal between the tundish sidewalls. Eliminating the gasket also allows for a greater tolerance between the sidewall and casting wheel, thereby further reducing vibration caused by contact between the wheel and sidewall. Continuous casting operations can be maintained using the inventive edge seals and risers without the need for a sealing gasket disposed between the tundish sidewalls and casting wheel. The inventive edge seals and risers provide an effective molten metal head level to solidify the molten metal at the cast strip edges in sufficient time to provide a sealing function and confine molten metal between the tundish sidewalls to prevent breakout conditions and casting shutdowns.

Figure 1:
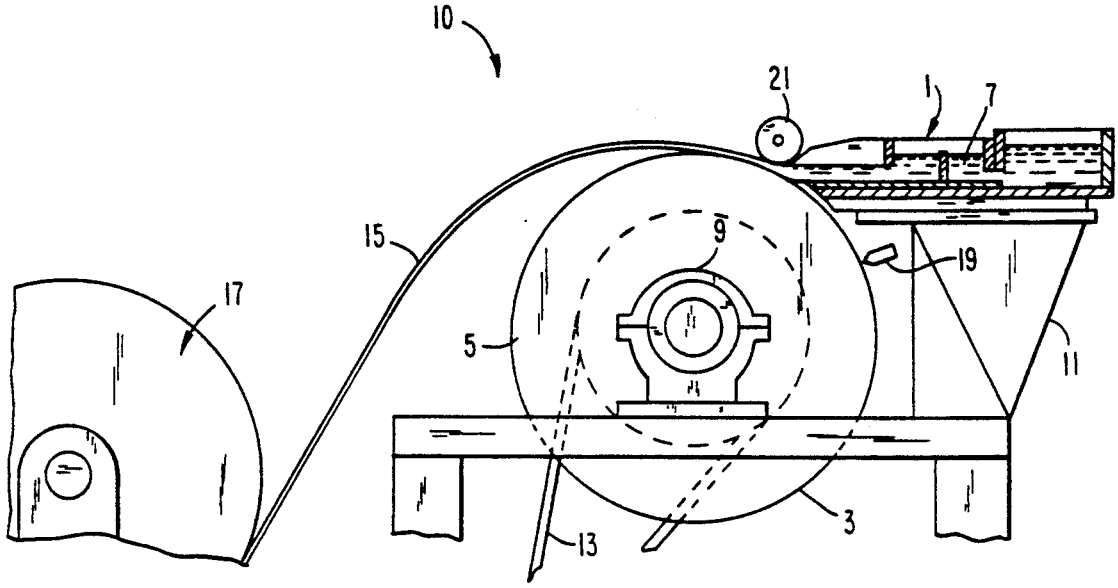
FIG. 1 PRIOR ART
FIG. 1 is a schematic diagram of a prior art continuous casting apparatus, with the tundish broken away to show greater detail.
Figure 2:
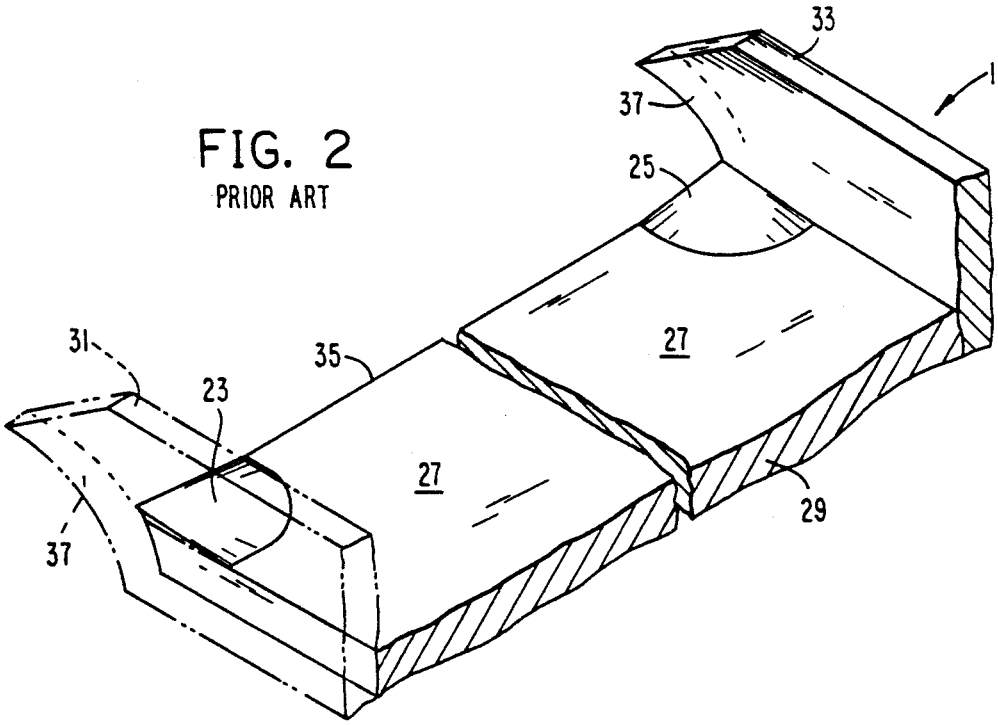
FIG. 2 PRIOR ART
FIG. 2 is a perspective view of a prior art tundish utilizing tundish outlet edge risers.
Figure 3:
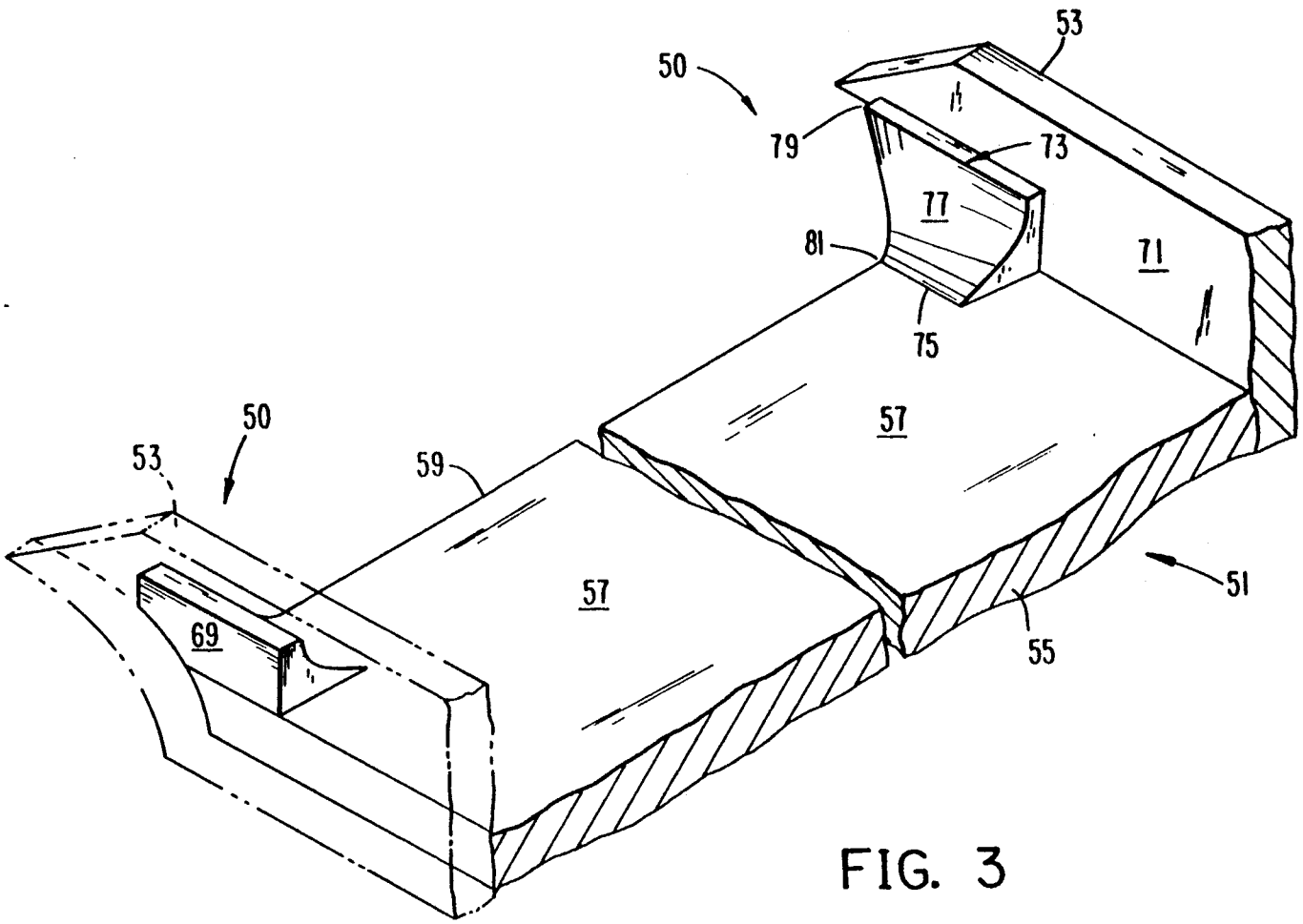
FIG. 3 is a perspective view of a tundish of a continuous casting apparatus showing the inventive edge seals and risers.

With reference now to FIG. 3, the inventive tundish outlet edge seals and risers are generally designated by the reference numeral 50 and are shown disposed on a portion of a tundish 51. The tundish 51 includes a pair of sidewalls 53 and a tundish floor 55 disposed between the sidewalls. The tundish floor includes a surface 57 and outlet lip 59.

With reference now to FIGS. 4 and 5, a top and front view of the tundish clearly illustrate the edge seal and riser configurations. In these figures, the tundish is shown with a flow control gate 62 having a front surface 64, the gate 62 being vertically adjustable. The flow control gate is described in greater detail in U.S. Pat. No. 4,828,012, as discussed above.

With reference now to FIG. 6, the tundish sidewalls 53 include a portion 61 which extends beyond the tundish lip 59. The portion 61 includes an upper inclined face 63 and a lower curved underside face 65. The curved face 65 is designed to follow the contour of the surface 67, shown in phantom in FIG. 6, for a driven casting wheel 68.

Each edge seal and riser 50 includes a plurality of differently shaped portions which permit the edge seal and riser to perform the various functions described above. With reference back to FIG. 3, each edge seal and riser has a face 69 designed to abut the inner face 71 of each sidewall 53.

The edge seal and riser includes a first portion having a predetermined height and thickness which functions to reduce the depth of molten metal adjacent the sidewalls 53 in the tundish and adjacent the sidewall portion 61 extending beyond the tundish outlet lip 59. With reference to FIG. 4, each edge seal and riser includes a top face 70 which extends outwardly from the sidewall 53 toward the longitudinal axis of the tundish. The face 70 terminates at an edge 73, see FIGS. 3 and 5. The top face 70 has a thickness "t" as denoted in FIG. 4.

With reference now to FIG. 6, the edge seal and riser extends upwardly from the tundish floor 57 for a predetermined height "h". Once the edge seal and riser extends beyond the tundish lip 59, the height "h" decreases since the lower surface of the edge riser follows the contour of the underside face 65 of the portion 61 of the sidewall 53 while the top face 70 remains horizontal.

By configuring the edge riser aspect of the invention to have a maximum height adjacent the inner face 71 of the sidewall 53, the molten metal in the tundish and adjacent the sidewall is reduced in depth. Moreover, the molten metal depth is also decreased when exiting the tundish by the edge riser extending along the tundish sidewall 53 beyond the tundish lip 59. As can be seen in FIG. 4, the face 70 extends beyond the tundish lip 59 to the point designated by the reference numeral 79. This extension of the edge riser further reduces the depth of molten metal contacting the casting chill wheel and provides improved strip solidification and sealing capabilities.

With reference now to FIGS. 3–5, the edge seal and riser extends from the edge 73 generally transversely toward the tundish longitudinal axis to an edge 75. A generally concave surface 77 is provided between the edges 73 and 75 which curves gradually toward the tundish longitudinal axis so as to smoothly blend into the tundish floor surface 57.

With particular reference to FIG. 4, the concave surface 77 extends from the reference numeral 79 in a further curved fashion so as to terminate at the reference numeral 81. With reference now to FIG. 6, the underside surface portion 83 of the edge seal and riser must generally follow the contour of the face 65 of the sidewall portion 61 so as to maintain the necessary spacing or gap 85 between the casting wheel surface 67 and sidewall face 65.

By projecting the edge seal and riser beyond the tundish outlet 59, the reduction in molten metal depth caused by the edge seal and riser upstream of the tundish lip 59 is maintained to permit solidification of the cast strip edge and improved sealing and casting operation. The rapid solidification at the cast strip edge prevents molten metal from entering the gap 85 between the casting wheel surface and sidewall 65 causing detrimental cast strip product quality and difficulties in the continuous casting operation.

The generally concave-shaped surface 77 provides a transition from the tundish sidewall region toward the tundish longitudinal axis. The portion of the concave-shaped surface 77 beyond the tundish lip 59 and the underside surface 83 contribute to molten metal head level reduction and extension of the gap 85 inwardly of the sidewalls 53. This gap extension facilitates formation of a meniscus of molten metal between the riser and casting wheel. The meniscus formation contributes to the rapid solidification of molten metal and improved sealing where the tundish lip and sidewalls join. By improving sealing and increasing the solidification of molten metal, a seal or gasket, which is typically used in prior art casting apparatus, can be eliminated without adverse effects on continuous casting operation or product quality. By elimination of the gasket, the gap 85 can be widened from about 0.010" in prior art apparatus to up to 0.035 inches, further reducing contact between the wheel and sidewall.

Although the edge seal and riser may be configured of any dimensions, preferred dimensions include a height of 1 ½ to almost 2 inches as measured from the tundish floor. Moreover, a preferred thickness of the face 70, see FIG. 4, includes about ½ inch. The concave-shaped surface 77 is a preferred embodiment for the edge seal and risers. However, other sloping transition surfaces such as a planar surface may be utilized.

The edge seals and risers may be made of any known material, with a preferred material being a high temperature refractory compound or composition. Preferably, the composition or compound selected for the edge seals and risers is of a higher temperature resistance than the sidewall material. By providing a higher temperature resistant material, improved insulating effects are provided for the tundish sidewall portion 61 to minimize thermal expansion thereof and potential contact with the casting wheel surface.

The edge seals and risers may be positioned in the tundish using any known means for fastening or bonding. Preferably, the edge seals and risers are positioned using a high temperature compound having adhesive qualities. The edge seals and risers may be first positioned in the tundish as a generally rectangular block with a curved face. After placement in the tundish, the underside surface 83 and curved face 77 may be shaped for alignment with the casting surface.

During the continuous casting of a molten metal material, e.g. an aluminum alloy, molten metal flows from the tundish onto a moving chill surface. This method of continuous casting is disclosed in U.S. Pat. No. 4,828,012 which has been incorporated by reference. When using the inventive edge seals and risers, the depth of molten metal flowing over the edge seals and risers is effected in at least two ways. First, the depth of molten metal adjacent the tundish sidewalls is lowered by the presence of the edge risers. This lowering of molten metal depth permits a more rapid solidification of molten metal when contacting the moving chill casting wheel surface. Thus, the cast strip edge is solidified more rapidly than the center portion of the cast strip. This rapid solidification provides a sealing function along the strip edge during continuous casting.

Besides lowering the depth of molten metal, the edge seals, by the presence of the sloping and generally concave-shaped surfaces extending beyond the tundish outlet lip, provide improved sealing functions during casting. Molten metal does not flow in the gap between the casting wheel surface and undersides of the sidewalls extending beyond the tundish outlet lip. Thus, a mechanical seal or gasket is not required when using the inventive edge seals.

Further, the edge seals and risers also provide an insulating effect to minimize thermal expansion in the area of the gap to minimize contact between the casting wheel and sidewall. Thus, the productivity of the continuous casting operation is increased since molten metal leakage is eliminated along with the casting apparatus shutdowns associated therewith. By using the inventive edge seals and risers, a continuous cast strip product is produced having improved edge quality and a more uniform strip cross-sectional profile as a result of the reduced metal thickness along the cast strip edges thereof. Further, the sealing effect of the inventive edge seals improves casting productivity by requiring less downtime as a result of molten metal leakage and interruption of the continuous casting process.

Although the edge seals and risers are disclosed for particular use in aluminum drag casting applications, any continuous casting apparatus or method using a tundish and moving casting surface may utilize the inventive edge seals and risers.

As such, an invention has been disclosed in terms of preferred embodiments thereof which fulfill each and every one of the objects of the present invention as set forth hereinabove and provides a new and improved edge seal and riser for use with a tundish in a continuous casting apparatus and method.

Various changes, modifications and alterations from the teachings of the present invention may be contemplated by those skilled in the art without departing from the intended spirit and scope thereof. Accordingly, it is intended that the present invention only be limited by the terms of the appended claims.

What is claimed is:

1. A method of producing a continuously cast metal strip having a uniform cross-sectional profile comprising the steps of:

a) providing a tundish having molten metal therein, said tundish including a tundish floor having an outlet lip and being disposed between a pair of sidewalls, a portion of said sidewalls extending beyond said outlet lip;

b) providing a moving chill surface adjacent said outlet lip, said moving chill surface and a bottom face of each said portion of each said sidewall forming a gap therebetween;

c) flowing said molten metal from said tundish onto said moving chill surface;

d) forming a meniscus of molten metal extending beyond said outlet lip, said meniscus adjacent to and spaced from each said gap to substantially prevent molten metal flow through said gaps;

e) withdrawing a strip of metal from said moving chill surface; and f) recovering said strip of metal.

2. The method of claim 1 further comprising the step of lowering the depth of molten metal in said tundish where said outlet lip meets said sidewalls so as to reduce the thickness of said cast metal strip on edge portions thereof, to increase molten metal solidification and to provide a more uniform cross-sectional profile.

3. The method of claim 1 wherein said sealing step further comprises providing a pair of edge seals, each edge seal disposed downstream of said outlet lip and adjacent a respective sidewall, each edge seal and said moving chill surface forming said another gap to facilitate formation of said meniscus.

4. The method of claim 2 wherein said forming and lowering steps further comprises the steps of providing a pair of edge seals and risers, each edge seal and riser including a first portion disposed adjacent a respective said sidewall, said first portion extending outwardly from said sidewall and upwardly from said tundish floor and a second portion extending outwardly from said sidewall and beyond said outlet lip.

5. In a melt drag metal strip casting apparatus wherein molten metal is delivered from a tundish onto a moving chill surface and a continuous strip of metal is withdrawn from said moving chill surface having a predetermined cross-sectional profile, wherein said tundish comprises a tundish floor having an outlet lip arranged between a pair of sidewalls, a portion of each said sidewall extending beyond said outlet lip and including a curved face aligned generally with said chill surface to form a gap between said portion and said curved face, the improvement comprising at least one edge seal disposed adjacent a said sidewall at an intersection of a said sidewall and said outlet lip, a portion of said edge seal having a curved bottom face aligned with said curved face of said portion of said sidewall, a sloping face and a top face, each of said top face, said sloping face and said curved bottom face extending substantially beyond said outlet lip, said top face being generally parallel to said tundish floor and including a terminating edge, said sloping face extending from said terminating edge to said tundish floor, said edge seal forming a meniscus downstream of said outlet lip and adjacent a said sidewall portion extending beyond said outlet lip to minimize molten metal leakage through said gap during casting.

6. The apparatus of claim 5 wherein said edge seal extends along each said portion of said sidewall and along said sidewall upstream of said outlet lip.

7. The apparatus of claim 6 wherein said edge seal extends upwardly from said tundish floor for lowering the depth of molten metal in said tundish adjacent each said sidewall and for lowering the depth of molten metal beyond said outlet lip to produce a cast strip product having a more uniform cross-sectional profile.

8. The apparatus of claim 5 further comprising a pair of edge seals, each edge seal disposed adjacent a respective said sidewall.

9. The apparatus of claim 5 wherein said top face gas a generally rectangular shape.

10. The apparatus of claim 5 wherein said sloping face includes a generally concave surface sloping toward a longitudinal axis of said tundish such that an edge thereof blends smoothly with said tundish floor.

11. A tundish for continuous casting of molten metal onto a moving chill surface comprising:

a) a tundish floor having an outlet lip;

b) a pair of sidewalls arranged on edges of said tundish floor; each said sidewall including a portion extending beyond said outlet lip having a curved bottom face; and c) sealing means disposed adjacent a respective said sidewall and downstream of said outlet lip for forming a meniscus of molten metal between said sealing means and said moving chill surface to prevent molten metal leakage during casting, said sealing means comprising at least one edge seal disposed adjacent a said sidewall at an intersection of a said sidewall and said outlet lip, a portion of said edge seal having a curved bottom face aligned with said curved face of said portion of said sidewall, a sloping face and a top face, each of said top face, said sloping face and said curved bottom face extending substantially beyond said outlet lip, said top face being generally parallel to said tundish floor and including a terminating edge, said sloping face extending from said terminating edge to said tundish floor, said edge seal forming a meniscus downstream of said outlet lip and adjacent a said sidewall portion extending beyond said outlet lip to minimize molten metal leakage through said gap during casting.

12. The apparatus of claim 11 wherein said edge seal extends along each said sidewall upstream and downstream of said outlet lip.

13. The apparatus of claim 12 wherein said edge seal extends upwardly from said tundish floor for lowering the depth of molten metal in said tundish adjacent each said sidewall and said outlet lip and for lowering the depth of molten metal downstream of said outlet lip to produce a cast strip product having a more uniform cross-sectional profile.

14. The apparatus of claim 11 further comprising a pair of edge seals, each edge seal disposed adjacent a respective said sidewall.

15. The apparatus of claim 11, wherein said top face has a generally rectangular shape.

16. The tundish of claim 11 wherein said sloping face has a generally concave surface sloping generally toward a longitudinal axis of said tundish such that an edge thereof blends smoothly with said tundish floor.

* * * * *